US005181281A

United States Patent [19]

Jang

[11] Patent Number: 5,181,281

[45] Date of Patent: Jan. 26, 1993

[54] DEVICE FOR CONTROLLING DISSOLUTION OF A SOLID CLEANSER

[76] Inventor: Ren-Yue Jang, 1F, No. 13, Alley 3, Lane 82, Fu-Hsing Rd., Taipei, Taiwan

[21] Appl. No.: 825,012

[22] Filed: Jan. 24, 1992

[51] Int. Cl.[5] ..... E03D 9/02

[52] U.S. Cl. ..... 4/227.2; 422/265; 422/277; 4/227.3

[58] Field of Search ..... 4/222, 227.1–227.5, 4/222.1; 422/265, 276–278

[56] References Cited

U.S. PATENT DOCUMENTS 1,928,483 9/1933 Gerome ..... 4/227.3
4,896,382 1/1990 Sokol et al. ..... 4/227.3

FOREIGN PATENT DOCUMENTS 0205272 10/1923 United Kingdom ..... 4/227.2

*Primary Examiner*—Charles E. Phillips

*Attorney, Agent, or Firm*—Harness, Dickey & Pierce

[57] ABSTRACT

A device to be placed in a water tank to control the dissolution of a solid cleanser includes a housing which has a weighed closed base to sink the housing to a bottom of the water tank, a surrounding wall detachably connected to the base and a top opening. The surrounding wall has an upper section and a perforated lower section. A floating container for receiving the solid cleanser is movably provided in the housing and includes a closed bottom, a perforated surrounding wall connected to the closed bottom, a top access opening and a cover detachably provided at the access opening. The floating container floats upwardly when the water tank is filled with water such that the cover blocks the top opening and a peripheral edge of the closed bottom abuts against an inner surface of the upper section so as to interrupt fluid communication between the floating container and the exterior of the housing and to prevent water from entering into the floating container, thereby preventing excessive dissolution of the solid cleanser.

5 Claims, 3 Drawing Sheets

DEVICE FOR CONTROLLING DISSOLUTION OF A SOLID CLEANSER

BACKGROUND OF THE INVENTION

1. FIELD OF THE INVENTION

This invention relates to a control device, more particularly to a device for controlling the dissolution of a solid cleanser.

2. DESCRIPTION OF THE PRIOR ART

A toilet includes a toilet tank and a toilet bowl. The toilet tank is generally provided with a cleanser therein to facilitate the cleaning of the toilet bowl. When placing a solid cleanser in the toilet tank, the solid cleanser continues to dissolve until the water in the toilet tank becomes saturated. It is wasteful that excessive amount of the solid cleanser is dissolved in the toilet tank.

SUMMARY OF THE INVENTION

Therefore, the objective of this invention is to provide a device to be placed in a water tank for controlling the dissolution of a solid cleanser, thereby preventing excessive dissolution of the solid cleanser.

Accordingly, a device of this invention is to be placed in a water tank to control the dissolution of a solid cleanser and includes a housing which has a weighed closed base to sink the housing to a bottom of the water tank, a surrounding wall detachably connected to the base, and a top opening. The surrounding wall has an upper section and a perforated lower section. A floating container for receiving the solid cleanser therein is movably provided in the housing. The floating container includes a closed bottom having a peripheral edge, a perforated surrounding wall connected to the closed bottom, a top access opening, and a cover detachably connected to the perforated surrounding wall so as to close the access opening. The floating container floats upwardly inside the housing when the water tank is filled with water such that the cover blocks the top opening of the housing and the peripheral edge of the closed bottom abuts against an inner surface of the upper section of the surrounding wall so as to interrupt fluid communication between the floating container and the exterior of the housing and to prevent water from entering into the floating container, thereby preventing excessive dissolution of the solid cleanser.

BRIEF DESCRIPTION OF THE DRAWING

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
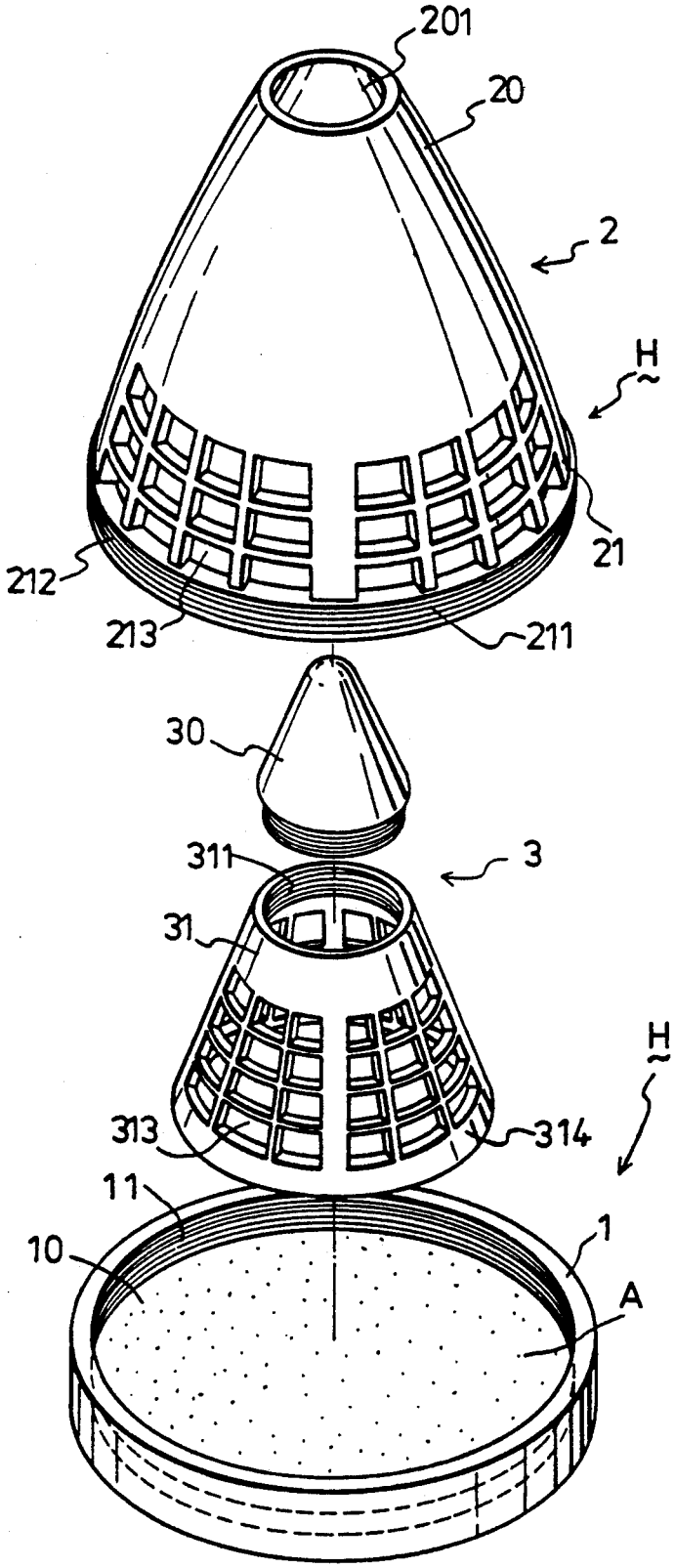
FIG. 1 is an exploded view of the device of this invention for controlling dissolution of a solid cleanser.

Referring to FIG. 1, a device of this invention, which is to be placed in a toilet tank (W) for controlling the dissolution of a solid cleanser (C), includes a cone-shaped housing (H) having an enlarged weighed closed base (1). The base (1) has a plate (10) with a lead member (A) provided thereon to sink the housing (H) to a bottom of the toilet tank (W), and an annular flange (11) which extends upwardly from a peripheral edge of the plate (10) and which is formed with interior threads. The housing (H) further includes an upwardly tapering surrounding wall (2) and a constricted top opening (201). The surrounding wall (2) has an upper section (20) and a lower section (21) which is provided with exterior threads (212) at a bottom (211) thereof to engage the interior threads of the flange (11) of the base (1). The lower section (21) is formed as a grill-like structure and has a plurality of through holes (213) formed thereon.

A cone-shaped floating container (3) for receiving the solid cleanser (C) therein is movably provided in the housing (H). The floating container (3) includes an enlarged closed bottom (314), an upwardly tapering surrounding wall (31) fixed to the bottom (314), a constricted top access opening (311) and an upwardly tapering cover (30) provided at the access opening (311) to engage threadedly with the surrounding wall (31) in order to close the access opening (311). The surrounding wall (31) is also formed as a grill-like structure and has a plurality of through holes (313) formed thereon.

Figure 2:
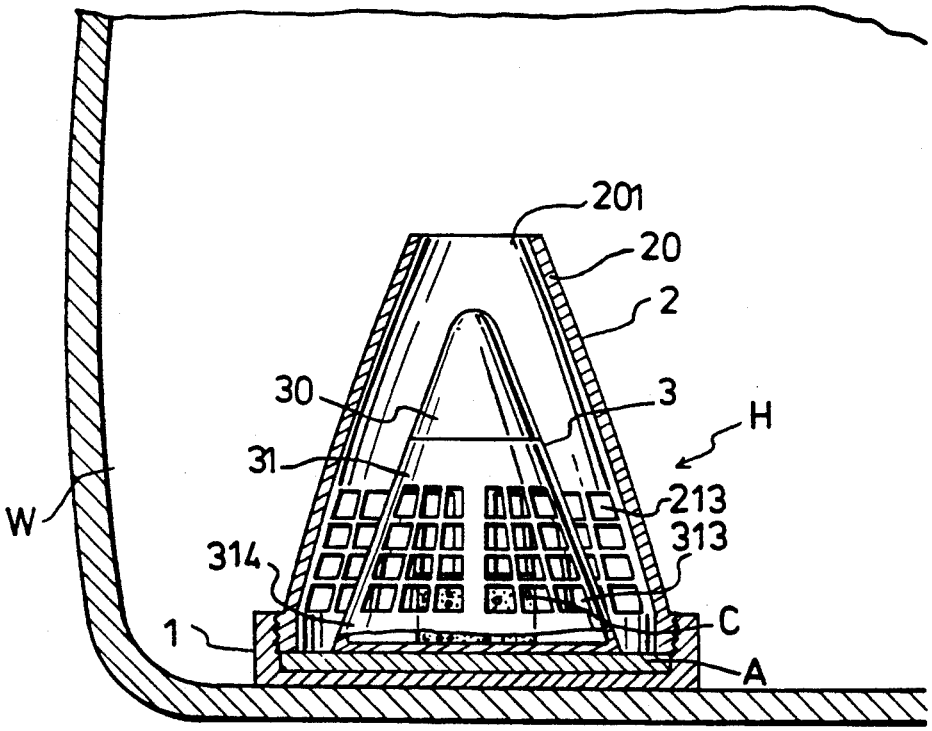
FIG. 2 is a sectional view of the device of this invention.
Figure 3:
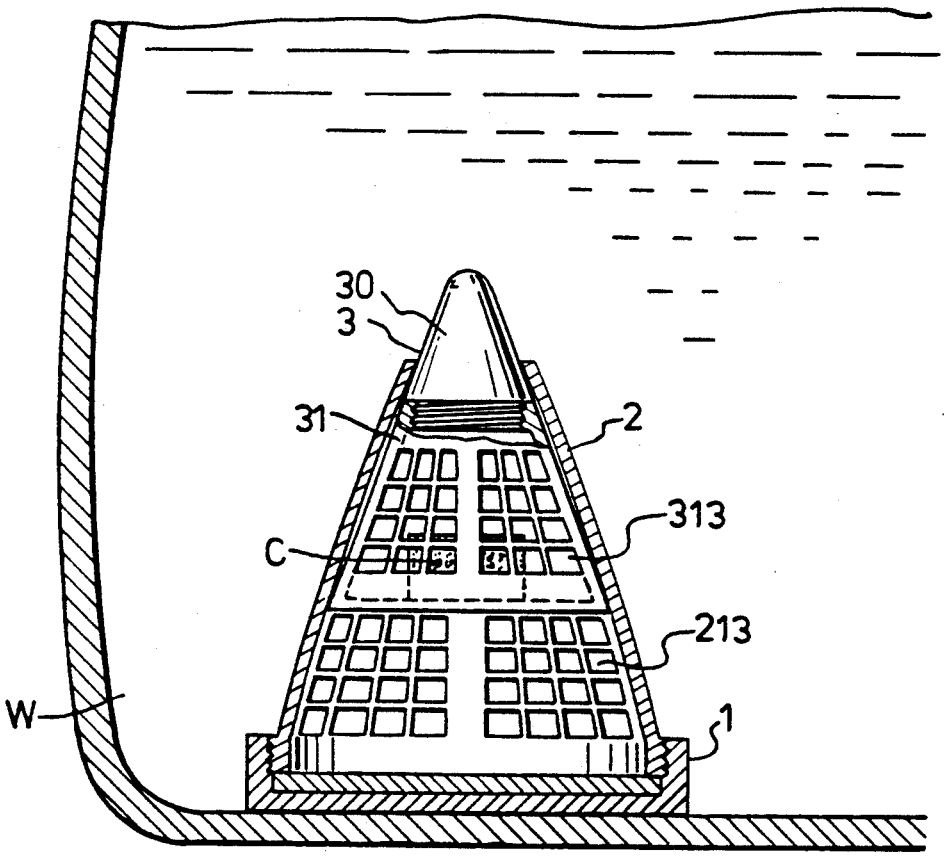
FIG. 3 shows a cone-shaped floating container of the device of this invention floating upwardly.

Referring to FIGS. 2 and 3, the base (1) of the housing (H) is placed at the bottom of the toilet tank (W) and the solid cleanser (C) is placed in the floating container (3). Water flows into the toilet tank (W) and dissolves part of the solid cleanser (C). The floating container (3) floats upwardly inside the housing (H) when the toilet tank (W) is filled with water such that the cover (30) protrudes out of and blocks the top opening (201) of the housing (H) and a peripheral edge of the closed bottom (314) of the floating container (3) abuts against an inner surface of the upper section (20) of the surrounding wall (2) so as to interrupt fluid communication between the floating container (3) and the exterior of the housing (H), thereby preventing water from entering into the floating container (3). The bottom (314) of the floating container (3) has a small amount of water contained therein, thus dissolving a small amount of the solid cleanser (C) received thereon. Dissolution of the solid cleanser (C) continues until the water in the bottom (314) becomes saturated. The floating container (3) moves downwards when water in the toilet tank (W) is discharged. The saturated water in the bottom (314) mixes with fresh water flowing into the toilet tank (W) to prepare for a succeeding toilet bowl cleaning operation.

Therefore, the excessive dissolution of the solid cleanser (C) is prevented by placing the solid cleanser (C) in the device of this invention.

While the present invention has been described in connection with what is considered the most practical and preferred embodiment, it is understood that this invention is not limited to the disclosed embodiment, but is intended to cover various arrangements included within the spirit and scope of the broadest interpretations and equivalent arrangements.

I claim:

1. A device to be placed in a water tank for controlling the dissolution of a solid cleanser, said device comprising:

a housing including a weighed closed base to sink said housing to a bottom of said water tank, a surrounding wall detachably connected to said base and a top opening, said surrounding wall having an upper section and a perforated lower section;

a floating container for receiving said solid cleanser therein, said floating container being movably provided in said housing and including a closed bottom having a peripheral edge, a perforated surrounding wall connected to said closed bottom, a top access opening and a cover detachably connected to said perforated surrounding wall so as to close said access opening, said floating container floating upwardly inside said housing when said water tank is filled with water such that said cover blocks said top opening of said housing and said peripheral edge of said closed bottom abuts against an inner surface of said upper section of said surrounding wall so as to interrupt fluid communication between said floating container and the exterior of said housing and to prevent water from entering into said floating container, thereby preventing excessive dissolution of said solid cleanser.

2. A device as claimed in claim 1, wherein said housing is cone-shaped, said weighed closed base is enlarged, said surrounding wall is upwardly tapering and said top opening is constricted; said floating container being cone-shaped, said closed bottom being enlarged, said perforated surrounding wall being upwardly tapering, said top access opening being constricted and said cover being upwardly tapering, said cover protruding out of and blocking said top opening of said housing when said floating container floats upwardly while said water tank is filled with water.

3. A device as claimed in claim 1, wherein said weighed closed base of said housing includes a lead member provided thereon.

4. A. device as claimed in claim 1, wherein said perforated lower section of said surrounding wall of said housing is formed as a grill-like structure.

5. A device as claimed in claim 1, wherein said perforated surrounding wall of said floating container is formed as a grill-like structure.

* * * * *